US005415369A

United States Patent [19]

Hungate

[11] Patent Number: 5,415,369

[45] Date of Patent: May 16, 1995

[54] RAILROAD IN-CAB SIGNALING WITH AUTOMATIC TRAIN STOP ENFORCEMENT UTILIZING RADIO FREQUENCY DIGITAL TRANSMISSIONS

[75] Inventor: Joe B. Hungate, Marion, Iowa

[73] Assignee: Rockwell International Corporation, Seal Beach, Calif.

[21] Appl. No.: 128,400

[22] Filed: Sep. 29, 1993

[51] Int. Cl.[6] ..... B61L 3/00

[52] U.S. Cl. ..... 246/167 R; 246/193

[58] Field of Search ..... 246/167 R, 176, 193, 246/220, 253, 62; 340/901, 905

[56] References Cited

U.S. PATENT DOCUMENTS

| | | | |
|---|---|---|---|
| 3,787,679 | 1/1974 | Birkin et al. | 246/167 R X |
| 3,937,432 | 2/1976 | Birkin | 246/167 R X |
| 4,735,383 | 4/1988 | Corrie | 246/167 R X |
| 4,742,460 | 5/1988 | Hollands | 246/167 R X |

FOREIGN PATENT DOCUMENTS

| | | | |
|---|---|---|---|
| 1273560 | 7/1968 | Germany | 246/167 R |
| 2428973 | 1/1975 | Germany | 246/267 R |
| 2633089 | 1/1978 | Germany | 246/167 R |

*Primary Examiner*—Robert J. Oberleitner
*Assistant Examiner*—S. Joseph Morano
*Attorney, Agent, or Firm*—Gregory G. Williams; M. Lee Murrah; H. Fredrick Hamann

[57] ABSTRACT

A railroad in-cab signaling system which includes transceivers disposed at signals where various transceivers are operating on different frequencies and addresses so as to provide for easy identification and highly secure communication to the signal transceiver and a tunable transceiver disposed on the locomotive, the locomotive transceiver being coupled to an interrogator which interrogates transponders disposed in the tracks, the transponders providing a message containing the predetermined frequency and address of the signal transceiver thereby allowing the locomotive transceiver to tune to the appropriate frequency and established a connection for the signal which it is approaching. The locomotive transceiver and the signal transceiver are then capable of exchanging information along the entire distance from the transponder to the signal.

4 Claims, 1 Drawing Sheet

RAILROAD IN-CAB SIGNALING WITH AUTOMATIC TRAIN STOP ENFORCEMENT UTILIZING RADIO FREQUENCY DIGITAL TRANSMISSIONS

FIELD OF THE INVENTION

The present invention generally relates to railroad electronics, and more particularly relates to in-cab signaling systems with automatic train stop enforcement which utilize radio frequency digital transmissions.

BACKGROUND OF THE INVENTION

In the past, in-cab signaling systems have operated on the principle of coded pulses transmitted between signal locations and a locomotive via the physical rails of the track or from loops buried beneath the tracks. The actual pulse is determined by the aspect (color) of the signal being approached by a given train. The coded pulses are received from the rails or loops by equipment on-board the locomotive, and the aspect of the signal that the train is approaching is displayed to the locomotive engineer.

Additionally, some on-board in-cab signal equipment have provided automatic train stop (ATS). ATS typically requires the locomotive engineer to acknowledge when the train receives a more restrictive signal aspect and to take appropriate action to comply with that signal aspect. If the locomotive engineer fails to take appropriate action, the on-board equipment will bring the train to a complete stop prior to violating the signal aspect.

While these systems have been utilized in the past, they do have several significant problems associated with them.

First of all, typically there is a relatively high cost associated with the track side and on-board equipment of both of these prior art systems. Secondly, in the track transmission line system the varying resistance of and between the rails (ballast resistance) can prevent the coded pulses from traveling the required distance from the signal to the locomotive. It can also be distorted to the point where the on-board equipment can not properly decode it, thus possibly creating an unsafe condition. Thirdly, the track based transmitters and the on-board in-cab signal receivers can drift in frequency causing the pulses to be undetectable. Lastly, in the buried loop system the time for communicating between the locomotive and the signal is limited by the size and number of loops and the time the locomotive is located over the loops, thus creating an "intermittent" type in-cab signaling system as opposed to a "continuous" system as proposed by this invention. The systems typically found in the prior art only provide information to the approaching locomotive. They do not typically provide a means for the transfer of information from the locomotive to other railroad entities. The present invention overcomes that problem. When the RF connection is made with specific signal locations that are uniquely equipped to accept information from an approaching locomotive, that locomotive can transmit data such as its electrical and mechanical health status, consumable levels and other pertinent operating data.

Consequently, there exists a need for improvement in in-cab signaling systems which do not exhibit all of the shortcomings of the prior art.

SUMMARY OF THE INVENTION

It is an object of the present invention to enhance safety of railroad operations.

It is a feature of the present invention to include an on-board interrogator and a transponder disposed between the railroad tracks at a predetermined distance from a signal.

It is an advantage of the present invention to assure effective communication between the appropriate signal and the correct locomotive.

It is another feature of the present invention to include an on-board radio frequency transceiver which is tunable to the various frequencies of various signal transceivers.

It is another advantage of the present invention to allow for extended communication between the locomotive and the signal, thus providing "continuous" in-cab signaling with automatic train stop protection.

The present invention provides an improved in-cab signaling system which is designed to satisfy the aforementioned needs, include the above described objects, contain the earlier articulated features and provide the previously stated advantages. The invention is carried out in a "track transmission line-less" system in the sense that the railroad tracks are not utilized as transmission lines between the signal and an approaching locomotive; and in a "buried loop-less" system in the sense that the loops buried beneath the tracks are eliminated. Instead, an on-board interrogator is utilized to interrogate transponders disposed between the tracks at a predetermined distance from a wayside signal location which has an RF transceiver for communicating with another RF transceiver disposed on-board the locomotive. The transponder provides the locomotive mounted interrogator; the unique frequency of the RF transceiver coupled to the signal, the unique digital address of the signal the train is approaching, and the distance from the transponder to the signal for braking curve calculations, so that the on-board RF transceiver can tune to the unique frequency of the signal transceiver.

Accordingly, the present invention includes an in-cab signaling system having an on-board RF transceiver, an on-board transponder interrogator, a transponder which is disposed at a predetermined distance from a signal which has an RF transceiver coupled thereto, so that, in response to signals received by the interrogator from the transponder, the on-board transceiver is tuned to the appropriate frequency and a highly secure data connection is established with the signal being approached to receive important information from the signal transceiver.

BRIEF DESCRIPTION OF THE DRAWINGS

The invention may be more fully understood by reading the following description of the preferred embodiments of the invention in conjunction with the appended drawings wherein.

DETAILED DESCRIPTION

Figure 1:
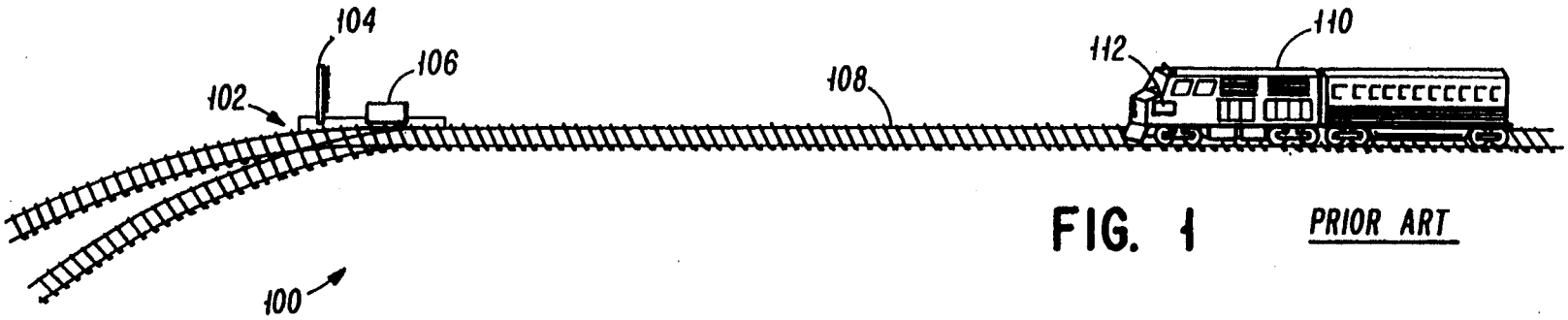
PRIOR ART FIG. 1
FIG. 1 is a schematic representation of a prior art system for communicating between a signal and an approaching locomotive which utilizes the railroad tracks as transmission lines.

Now referring to the drawings, where like numerals refer to like text and matter throughout and more particularly referring to FIG. 1, there is shown an in-cab signaling system, of the prior art, generally designated 100, having a rail switch 102 which is coupled to a wayside signal 104 which has a DC pulse transmitter 106 coupled thereto. Transmitter 106 provides a signal to the rails 108. The signal then travels to the approaching locomotive 110 which has a receiver 112 thereon which is capable of receiving the signal provided on the rail 108.

Figure 2:
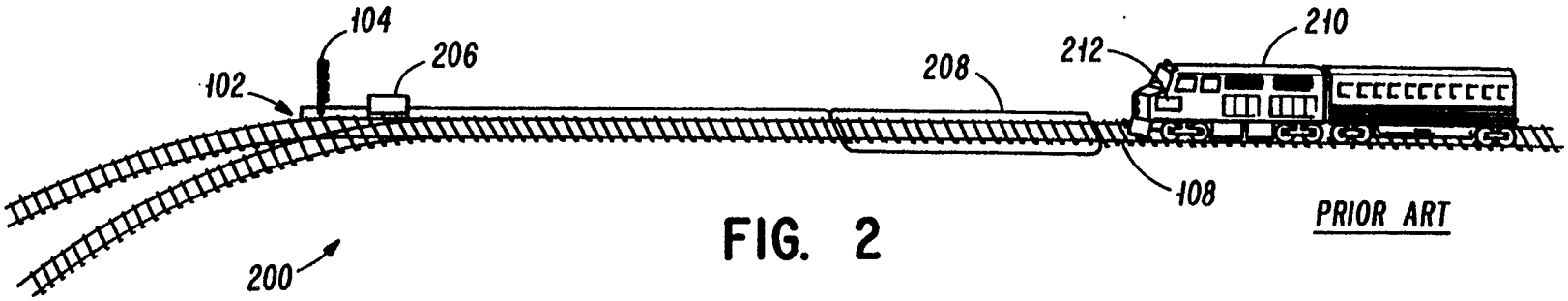
PRIOR ART FIG. 2
FIG. 2 is a schematic representation of a prior art system which utilizes buried loops beneath the tracks.

Now referring to FIG. 2, there is shown an in-cab signaling system, of the prior art, generally designated 200, having a rail switch 102 coupled to a wayside signal 104 and a transmitter 206 which provides signals to a loop 208 which is disposed beneath the rails 108. The loop 208 is provided with a variable current of encoded pulses which transmit a message to the approaching locomotive 210 which has disposed thereon a receiver 212 for receiving the pulses from loop 208.

Figure 3:
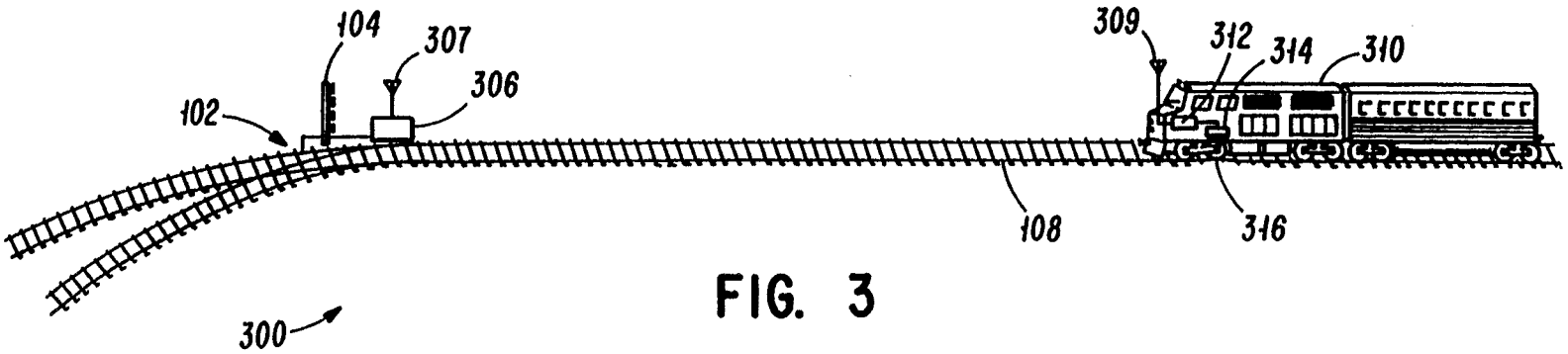
FIG. 3 is a schematic representation of the in-cab signaling system, of the present invention, which clearly shows the RF link between the approaching locomotive and the signal.

Now referring to FIG. 3, there is shown an in-cab signaling system, of the present invention, generally designated 300, including a rail switch 102, a wayside signal 104 coupled thereto and a RF signal transceiver 306 with a RF signal transceiver antenna 307 coupled thereto. In alternate embodiments more than one wayside signal similar to signal 104 could be coupled to transceiver 306, where the signals are disposed on more than one track with each track having assigned thereto a unique track address. RF signals are transmitted to locomotive transceiver antenna 309 which is coupled to locomotive transceiver 312 which is disposed on remote locomotive 310. Also coupled to remote locomotive 310 is interrogator 314 which interrogates transponder 316 which is disposed between or adjacent to the tracks 108.

In operation, the present invention provides for enhanced communication between an approaching locomotive and a signal as follows: the remote locomotive 310 is progressing along the tracks 108 in a direction toward the wayside signal 104 and encounters a transponder 316, which is disposed at a predetermined distance from the wayside signal 104. Interrogator 314 interrogates the transponder 316 which responds with a coded message including at least the frequency and secure address of the RF signal transceiver 306. The locomotive transceiver 312 is then tuned to the unique frequency of RF signal transceiver 306 and either initiates a signal to RF signal transceiver 306 or receives signals emminating from RF signal transceiver 306. As the locomotive 310 approaches the wayside signal 104, the locomotive 310 is capable of constant communication with the signal. Only the approaching locomotive that has established a data connection to that signal will receive the important information pertaining to that signal. The information provided to the approaching locomotive can consist of the aspect of the signal, permanent or temporary speed restrictions or other special train handling information. The on-board locomotive equipment can then utilize this information to enhance even further the automatic train stop feature of the present invention.

It is thought that the railroad in-cab signaling system, of the present invention, and many of its attendant advantages will be understood from the foregoing description and it will be apparent that various changes may be made in the form, the construction and the arrangements of the parts thereof without departing from the spirit and scope of the invention or sacrificing all of their material advantages. The form herein being described is merely a preferred or exemplary embodiment thereof.

I claim:

1. A railroad in-cab signaling system, for communicating information regarding switches and signals to locomotives, the system comprising:

a signal coupled to a rail switch;

an RF signal transceiver coupled to the signal, for transmitting high secure messages to an approaching locomotive on a predetermined radio frequency and address;

a transponder, disposed a predetermined distance from the signal for transmitting a predetermined signal frequency and address message, when interrogated;

an interrogator, disposed on the approaching locomotive, for interrogating the transponder, and receiving the predetermined signal transceiver frequency and address message;

an RF transceiver, disposed on the approaching locomotive, for transmitting messages to and receiving messages from the signal transceiver; and, the RF transceiver is tunable to various predetermined frequencies in response to the predetermined signal frequency message received by the interrogator.

2. A railroad signaling system comprising:

a railroad signal, disposed at a predetermined location along a railroad track;

a first radio transceiver coupled to the signal;

a second radio transceiver, disposed on a rail vehicle, for communicating with said first radio transceiver;

a transponder disposed at a predetermined distance from the signal;

an interrogator disposed on said rail vehicle for interrogating the transponder; and wherein said first transceiver operates at a predetermined frequency;

wherein said second transceiver is tunable to various frequencies including the predetermined frequency of the first transceiver, the second transceiver tuning to different frequencies in response to signals transmitted by the transponder.

3. A system of claim 2 wherein the transponder further transmits address information representative of a signal aspect of a particular track.

4. A system of claim 3 wherein the first transceiver is coupled to a plurality of signals disposed on a plurality of railroad tracks, each track having assigned thereto a unique track address.

* * * * *